US007025293B2

(12) United States Patent
Matlin et al.

(10) Patent No.: US 7,025,293 B2
(45) Date of Patent: Apr. 11, 2006

(54) SHREDDER WITH PIVOTING HOUSING FOR THE SHREDDER MECHANISM

(75) Inventors: Taihoon K Matlin, Round Lake Beach, IL (US); David G Hartnett, Carol Stream, IL (US); Devin Lee Moore, Decatur, GA (US); Matthew Luis Rivera, Mableton, GA (US); Nheeda C Enriquez, Jersey City, NJ (US)

(73) Assignee: Fellows Inc., Itasca, IL (US)

( * ) Notice: Subject to any disclaimer, the term of this patent is extended or adjusted under 35 U.S.C. 154(b) by 119 days.

(21) Appl. No.: 10/828,254

(22) Filed: Apr. 21, 2004

(65) Prior Publication Data

US 2005/0236503 A1 Oct. 27, 2005

(51) Int. Cl.
*B02C 18/16* (2006.01)

(52) U.S. Cl. ..... 241/100; 241/236; 241/285.3

(58) Field of Classification Search ..... 241/100, 241/236, 285.3; 220/4.01, 908, 908.3
See application file for complete search history.

(56) References Cited

U.S. PATENT DOCUMENTS

| | | | | |
|---|---|---|---|---|
| 3,419,223 | A * | 12/1968 | Morin | 241/73 |
| 4,172,400 | A | 10/1979 | Brierley | |
| 4,564,146 | A | 1/1986 | Bleasdale | |
| 4,637,560 | A | 1/1987 | Goldhammer | |
| 4,973,004 | A | 11/1990 | Krause et al. | |
| D362,866 | S | 10/1995 | Johansson | |
| D375,973 | S | 11/1996 | Kennedy et al. | |
| 5,826,809 | A | 10/1998 | Kroger | |
| 5,839,675 | A | 11/1998 | Henreckson et al. | |
| 5,853,131 | A | 12/1998 | Cheng | |
| D404,756 | S | 1/1999 | Dziersk | |
| D412,716 | S | 8/1999 | Kroger | |
| 5,961,059 | A | 10/1999 | Kroger | |
| 5,969,310 | A | 10/1999 | Schwelling | |
| 5,988,542 | A | 11/1999 | Henreckson et al. | |
| 6,079,645 | A | 6/2000 | Henreckson et al. | |
| D434,433 | S | 11/2000 | Hung | |
| D437,343 | S | 2/2001 | Ho | |
| D451,948 | S | 12/2001 | Wu et al. | |
| D455,170 | S | 4/2002 | Ho | |
| 6,460,790 | B1 | 10/2002 | Wu Huang | |
| D474,231 | S | 5/2003 | Lammers et al. | |
| D481,416 | S | 10/2003 | Chang | |
| 2005/0072869 | A1 * | 4/2005 | Ting | 241/100 |

FOREIGN PATENT DOCUMENTS

| | | | |
|---|---|---|---|
| DE | 36 07 752 | | 9/1987 |
| DE | 296 22 139 | | 4/1997 |
| DE | 196 18 478 | | 9/1997 |
| EP | 0010681 | * | 5/1980 |

* cited by examiner

*Primary Examiner*—Mark Rosenbaum
(74) *Attorney, Agent, or Firm*—Pillsbury Winthrop Shaw Pittman, LLP

(57) ABSTRACT

The present invention relates to a shredder wherein the shredder housing can be pivoted between a generally horizontal orientation and a generally vertical orientation.

74 Claims, 8 Drawing Sheets

SHREDDER WITH PIVOTING HOUSING FOR THE SHREDDER MECHANISM

FIELD OF THE INVENTION

The present invention relates to shredders for destroying articles, such as documents, CDs, etc.

BACKGROUND OF THE INVENTION

Shredders are well known devices for destroying articles, such as documents, CDs, floppy disks, etc. Typically, users purchase shredders to destroy sensitive articles, such as credit card statements with account information, documents containing company trade secrets, etc.

A common type of shredder has a shredder mechanism contained within a housing that is removably mounted atop a container. The shredder mechanism typically has a series of cutter elements that shred articles fed therein and discharge the shredded articles downwardly into the container. When it is desired to service the shredder mechanism, or clear jammed articles from the cutter elements, the housing is typically lifted off the container to provide access to the underside of the shredder mechanism or for emptying the container. Typically, this is done by lifting the housing vertically off the container with two hands.

The present invention endeavors to provide a simpler and more ergonomically efficient approach to removing the shredder housing from its operative position on a container.

SUMMARY OF THE INVENTION

One aspect of the present invention provides a shredder comprising a seat, a shredder housing, and a shredder mechanism including a motor and cutter elements. The shredder mechanism enables articles to be shredded to be fed into the cutter elements and the motor is operable to drive the cutter elements so that the cutter elements shred the articles fed therein.

The seat has a pivot guide and the shredder housing includes a pivot mount. The shredder housing is constructed to be removably mounted to the seat in a generally horizontal orientation with the pivot mount removably engaged with the pivot guide. The pivot mount and the pivot guide are constructed to pivotally mount the shredder housing for pivotal movement between the generally horizontal orientation and a generally vertical orientation.

Another aspect of the invention provides a shredder with a waste opening feature. The shredder of this aspect of the invention comprises a seat, a shredder housing, and a shredder mechanism including a motor and cutter elements. The shredder mechanism enables articles to be shredded to be fed into the cutter elements and the motor is operable to shred the articles fed therein. The shredder mechanism is mounted in the shredder housing. The shredder housing is constructed to be removably mounted to the seat.

The shredder housing includes a waste opening spaced apart from the shredder mechanism for enabling articles to be discarded through the waste opening without passing through the shredder mechanism. A handle is coupled to the shredder housing and facilitates removal of the shredder housing from the seat. The handle defines at least a portion of the waste opening.

Other objects, features, and advantages of the present invention will become apparent from the following detailed description, the accompanying drawings, and the appended claims.

DETAILED DESCRIPTION OF THE ILLUSTRATED EMBODIMENTS

FIGS. 1–8 illustrate an embodiment of a shredder constructed in accordance with one embodiment of the present invention. The shredder is generally indicated at 10. The shredder 10 sits atop a waste container, generally indicated at 12, which is formed of molded plastic or any other material. The shredder 10 illustrated is designed specifically for use with the container 12, as the shredder housing 14 sits on the upper periphery of the waste container 12 in a nested relation, which will be discussed in further detail below. Generally speaking, the shredder 10 may have any suitable construction or configuration and the illustrated embodiment is not intended to be limiting in any way.

Figure 8:
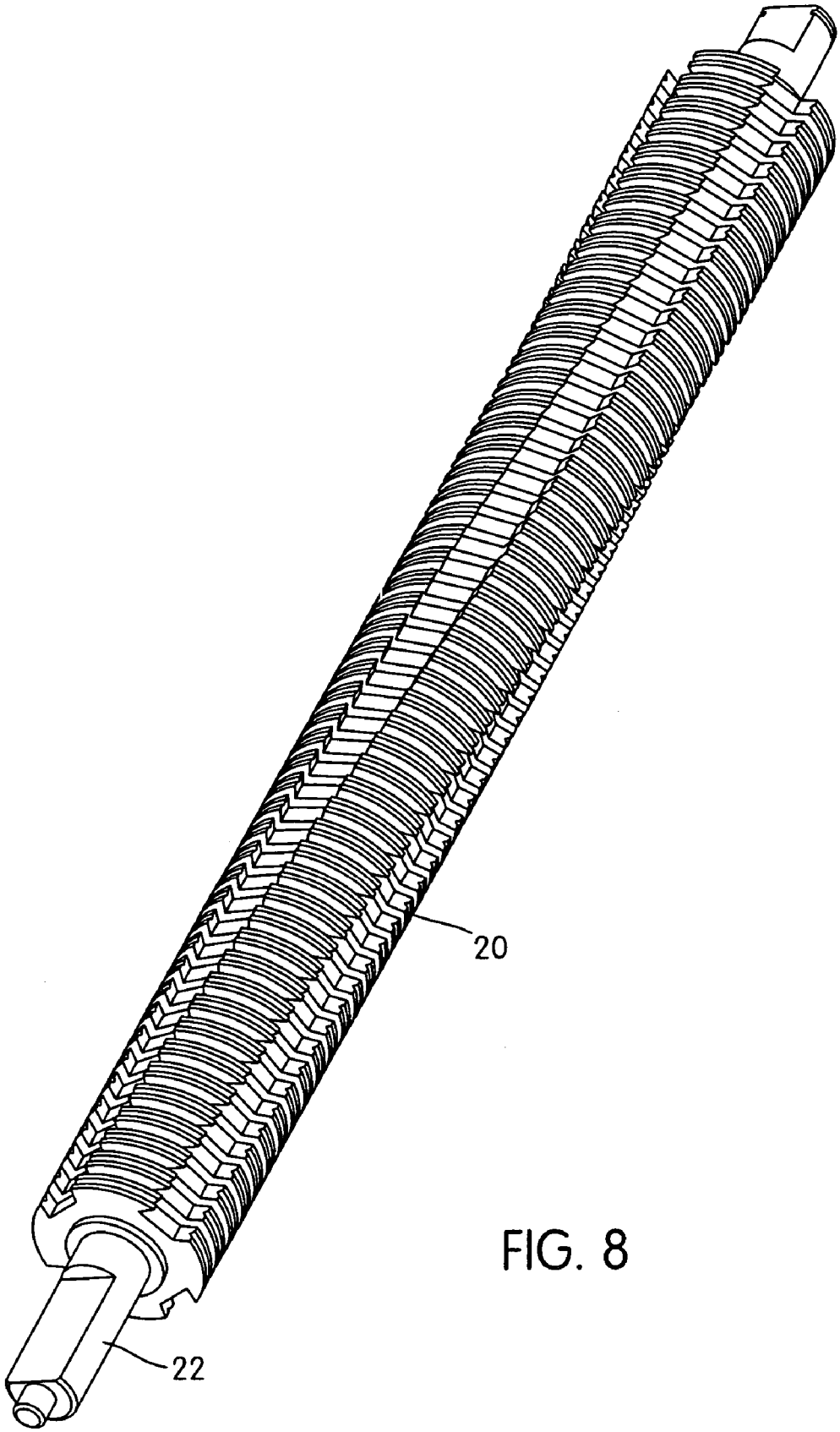
FIG. 8 is a perspective view of a shaft and cutter element used in the shredder.

The shredder 10 includes a shredder mechanism 16 including an electrically powered motor 18 and a plurality of cutter elements 20. The cutter elements 20 are mounted on a pair of parallel rotating shafts 22, one of which is shown in FIG. 8. The motor 18 operates using electrical power to rotatably drive the shafts 22 and the cutter elements 20 through a conventional transmission 23 so that the cutter elements 20 shred articles fed therein. The shredder mechanism 16 may also include a sub-frame 21 for mounting the shafts 22, the motor 18 and the transmission 23. The operation and construction of such a shredder mechanism 16 are well known and need not be described herein in detail. Generally, any suitable shredder mechanism 16 known in the art or developed hereafter may be used.

The shredder 10 also includes the shredder housing 14, mentioned above. The shredder housing 14 includes top wall 24 that sits atop the container 12. The top wall 14 is molded from plastic and an opening 26 is located at a front portion thereof. The opening 26 is formed in part by a downwardly depending generally U-shaped member 28. The U-shaped member 28 has a pair of spaced apart connector portions 27 on opposing sides thereof and a hand grip portion 28 extending between the connector portions 27 in spaced apart relation from the housing 14. The opening 26 allows waste to be discarded into the container 12 without being passed through the shredder mechanism 16, and the member 28 may act as a handle for carrying the shredder 10 separate from the container 12. As an optional feature, this opening 26 may be provided with a lid, such as a pivoting lid, that opens and closes the opening 26. However, this opening in general is optional and may be omitted entirely. Moreover, the shredder housing 14 and its top wall 24 may have any suitable construction or configuration.

The shredder housing 14 also includes a bottom receptacle 30 having a bottom wall, four side walls and an open top. The shredder mechanism 16 is received therein, and the receptacle 30 is affixed to the underside of the top wall 24 by fasteners. The receptacle 30 has an opening 32 in its bottom wall through which the shredder mechanism 16 discharges shredded articles into the container 12. For more details on this structure, reference may be made to the U.S. Patent Application for which a serial number has not been assigned, by Taihoon K. Matlin et al., entitled Shredder with Lock for On/Off Switch filed Apr. 2, 2004, the entirety of which is hereby incorporated into the present application by reference.

The top wall 24 has a generally laterally extending opening 36 extending generally parallel and above the cutter elements 20. The opening 36, often referred to as a throat, enables the articles being shredded to be fed into the cutter elements 20. As can be appreciated, the opening 36 is relatively narrow, which is desirable for preventing overly thick items, such as large stacks of documents, from being fed into cutter elements 20, which could lead to jamming. The opening 36 may have any configuration.

The top wall 24 also has a switch recess 38 with an opening therethrough. An on/off switch 42 includes a switch module (not shown) mounted to the top wall 24 underneath the recess 38 by fasteners, and a manually engageable portion 46 that moves laterally within the recess 38. The switch module has a movable element (not shown) that connects to the manually engageable portion 46 through the opening 40. This enables movement of the manually engageable portion 46 to move the switch module between its states.

In the illustrated embodiment, the switch module connects the motor 18 to the power supply (not shown). Typically, the power supply will be a standard power cord 44 with a plug 48 on its end that plugs into a standard AC outlet. The switch 42 is movable between an on position and an off position by moving the portion 46 laterally within the recess 38. In the on position, contacts in the switch module are closed by movement of the manually engageable portion 46 and the movable element to enable a delivery of electrical power to the motor 18. In the off position, contacts in the switch module are opened to disable the delivery of electric power to the motor 18.

As an option, the switch 42 may also have a reverse position wherein contacts are closed to enable delivery of electrical power to operate the motor 18 in a reverse manner. This would be done by using a reversible motor and applying a current that is of a reverse polarity relative to the on position. The capability to operate the motor 18 in a reversing manner is desirable to move the cutter elements 20 in a reversing direction for clearing jams. In the illustrated embodiment, in the off position the manually engageable portion 46 and the movable element would be located generally in the center of the recess 38, and the on and reverse positions would be on opposing lateral sides of the off position.

Generally, the construction and operation of the switch 42 for controlling the motor 42 are well known and any construction for such a switch 42 may be used.

The top cover 24 also includes another recess 50 associated with a switch lock 52. The switch lock 52 includes a manually engageable portion 54 that is movable by a user's hand and a locking portion (not shown). The manually engageable portion 54 is seated in the recess 50 and the locking portion is located beneath the top wall 24. The locking portion is integrally formed as a plastic piece with the manually engageable portion 54 and extends beneath the top wall 24 via an opening formed in the recess 50.

The switch lock 52 causes the switch 42 to move from either its on position or reverse position to its off position by a camming action as the switch lock 52 is moved from a releasing position to a locking position. In the releasing position, the locking portion is disengaged from the movable element of the switch 42, thus enabling the switch 42 to be moved between its on, off, and reverse positions. In the locking position, the movable element of the switch 42 is restrained in its off position against movement to either its on or reverse position by the locking portion of the switch lock 52.

Preferably, but not necessarily, the manually engageable portion 54 of the switch lock 52 has an upwardly extending projection 56 for facilitating movement of the switch lock 52 between the locking and releasing positions.

One advantage of the switch lock 52 is that, by holding the switch 42 in the off position, to activate the shredder mechanism 16 the switch lock 52 must first be moved to its releasing position, and then the switch 42 is moved to its on or reverse position. This reduces the likelihood of the shredder mechanism 16 being activated unintentionally.

The construction and operation of the switch lock 52 and its relationship with the switch 42 is described in further detail in the U.S. patent application of Matlin et al. mentioned above.

In the illustrated embodiment, the shredder housing 14 is designed specifically for use with the container 12 and it is intended to sell them together. The upper peripheral edge 60 of the container 12 defines an upwardly facing opening 62, and provides a seat 61 on which the shredder 10 is removably mounted. The seat 61 includes a pair of pivot guides 64 provided on opposing lateral sides thereof. The pivot guides 64 include upwardly facing recesses 66 that are defined by walls extending laterally outwardly from the upper edge 60 of the container 12. The walls defining the recesses 66 are molded integrally from plastic with the container 12, but may be provided as separate structures and formed from any other material. At the bottom of each recess 66 is provided a step down or ledge providing a generally vertical engagement surface 68. This step down or ledge is created by two sections of the recesses 66 being provided with different radii.

The shredder housing 14 has a pair of pivot mounts 70 provided on opposing lateral sides thereof. Each of the pivot mounts 70 includes a wall 72 extending laterally outwardly that has a generally semi-circular configuration. The walls 72 are molded integrally from plastic with the housing 14, but may be provided as separate structures and formed from any other material. The configuration generally corresponds to the configuration of the recesses 66 on the container 12. During normal usage, the shredder 10 is removably mounted in a generally horizontal orientation on the upper peripheral edge 60 of the container 12 with the pivot mounts 70, particularly the semi-circular walls 72, received in the upwardly facing recesses 66 of the pivot guides 64. This is shown best in FIGS. 4, 6 and 7.

Figure 1:
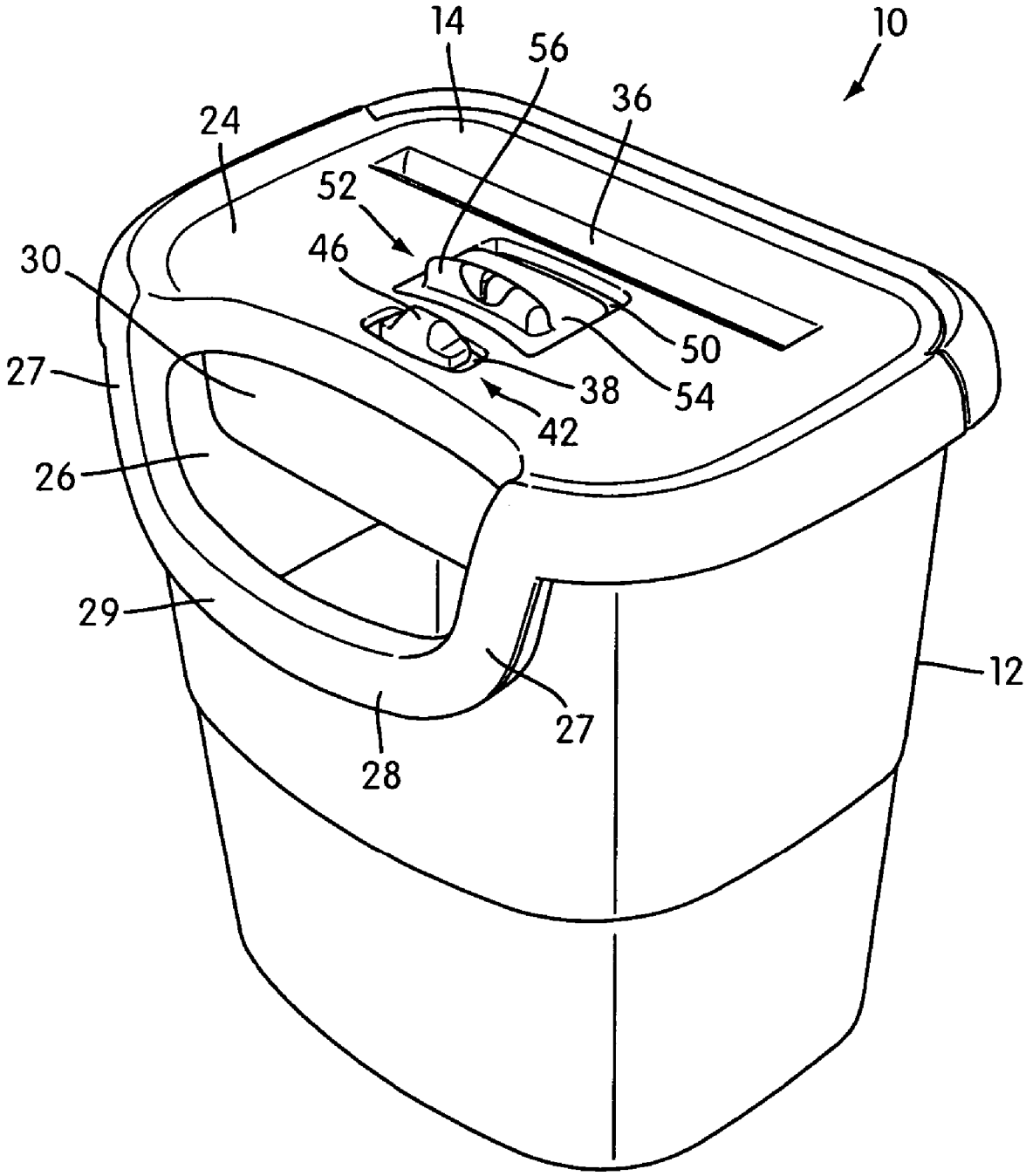
FIG. 1 is a perspective view of a shredder constructed in accordance with an embodiment of the present invention.
Figure 2:
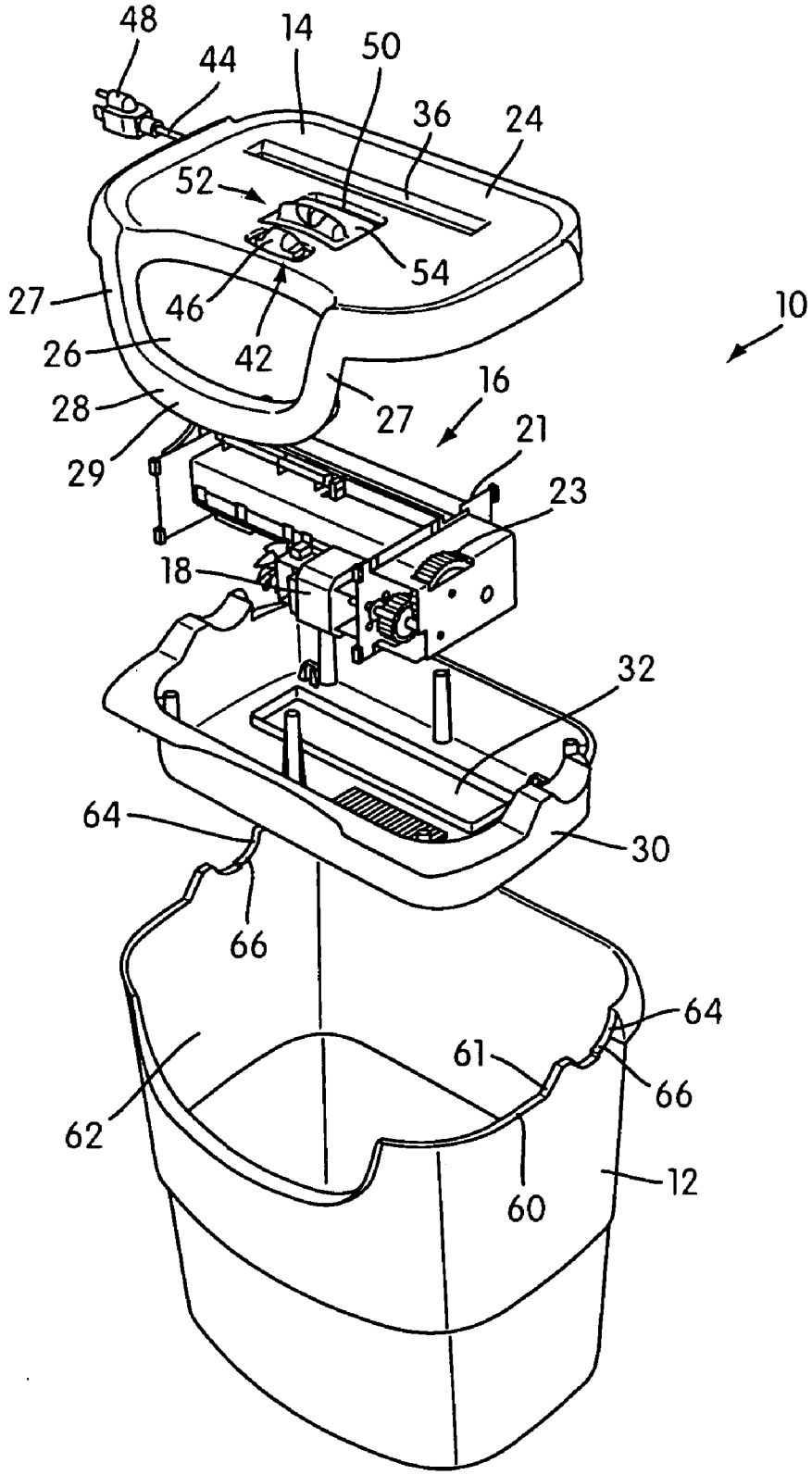
FIG. 2 is an exploded perspective view of the shredder of FIG. 1.
Figure 3:
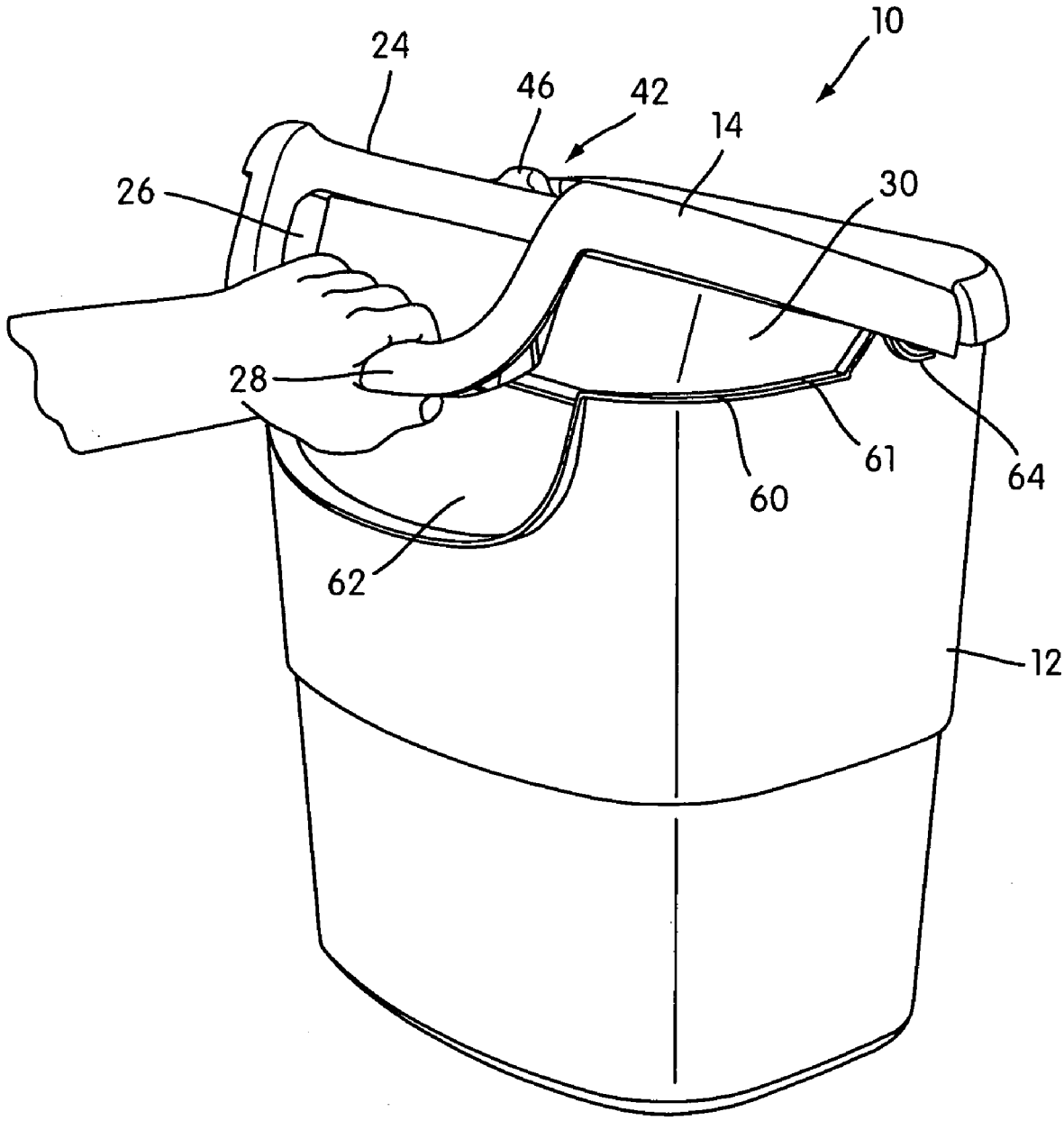
FIG. 3 is a perspective view of the shredder of FIG. 1, showing the shredder being pivoted from its generally horizontal use position.
Figure 4:
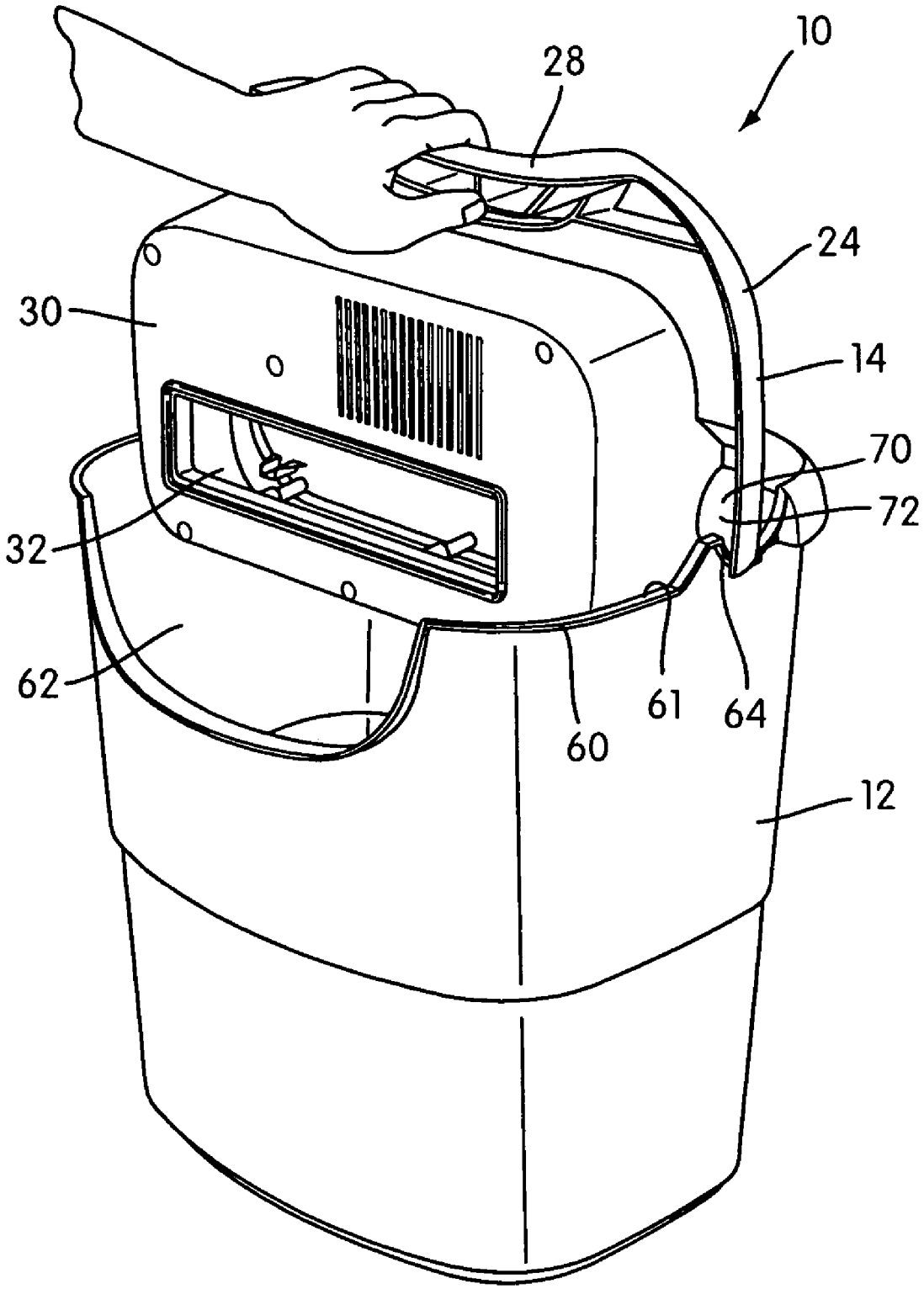
FIG. 4 is a perspective view of the shredder of FIG. 1, showing the shredder in its generally vertical orientation.

To remove the shredder 10 from the container 12 for purposes of emptying the container 12 or clearing a jam from the underside of the shredder mechanism 16, the user can manually grab the handle 28 with his/her hand as shown in FIG. 3. Then the user can pivot the shredder 10 by the handle 28 up to the generally vertical position shown in FIG.

Figure 5:
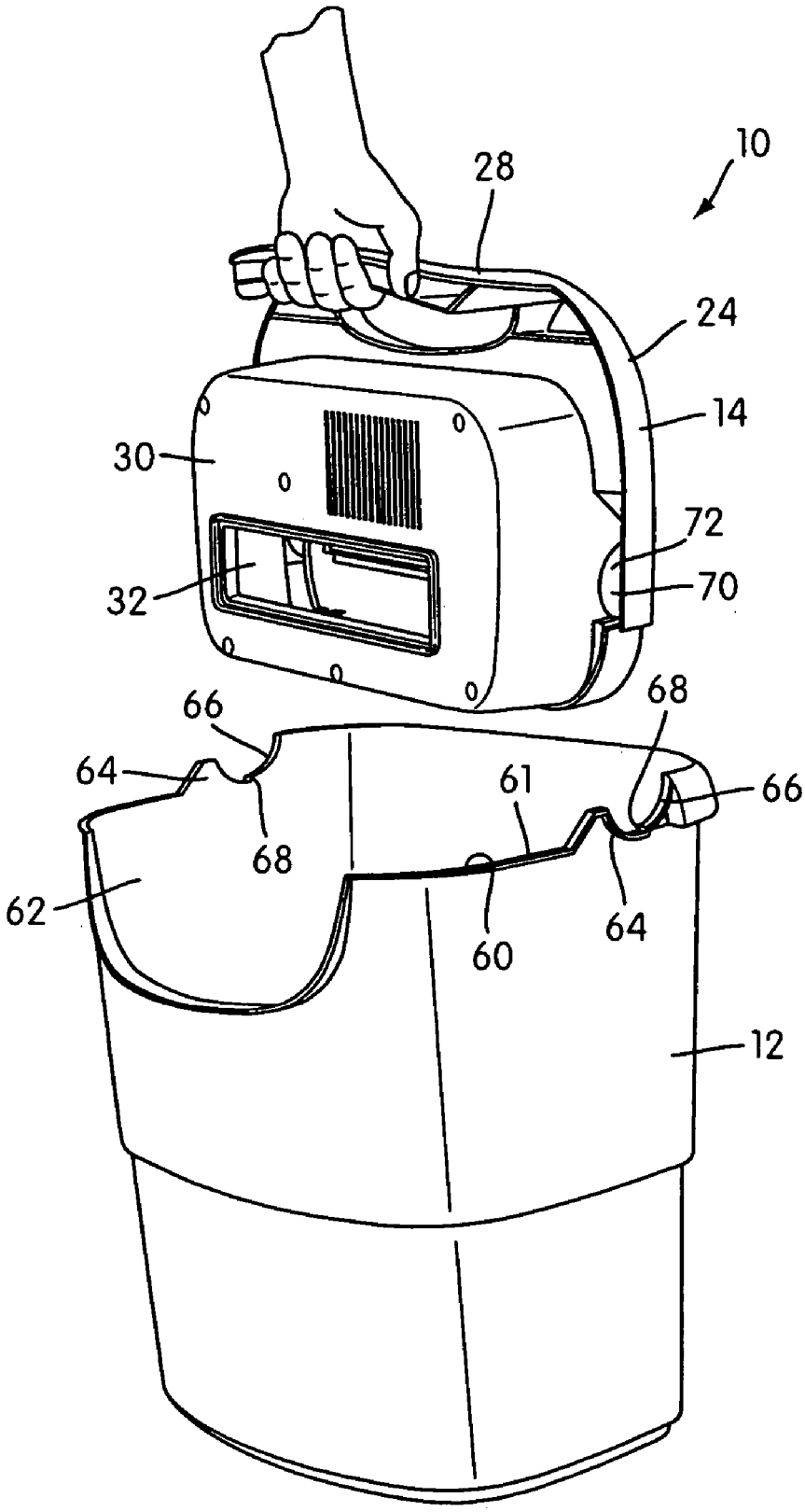
FIG. 5 is a perspective view of the shredder of FIG. 1, showing the shredder being lifted off of the container.
Figure 6:
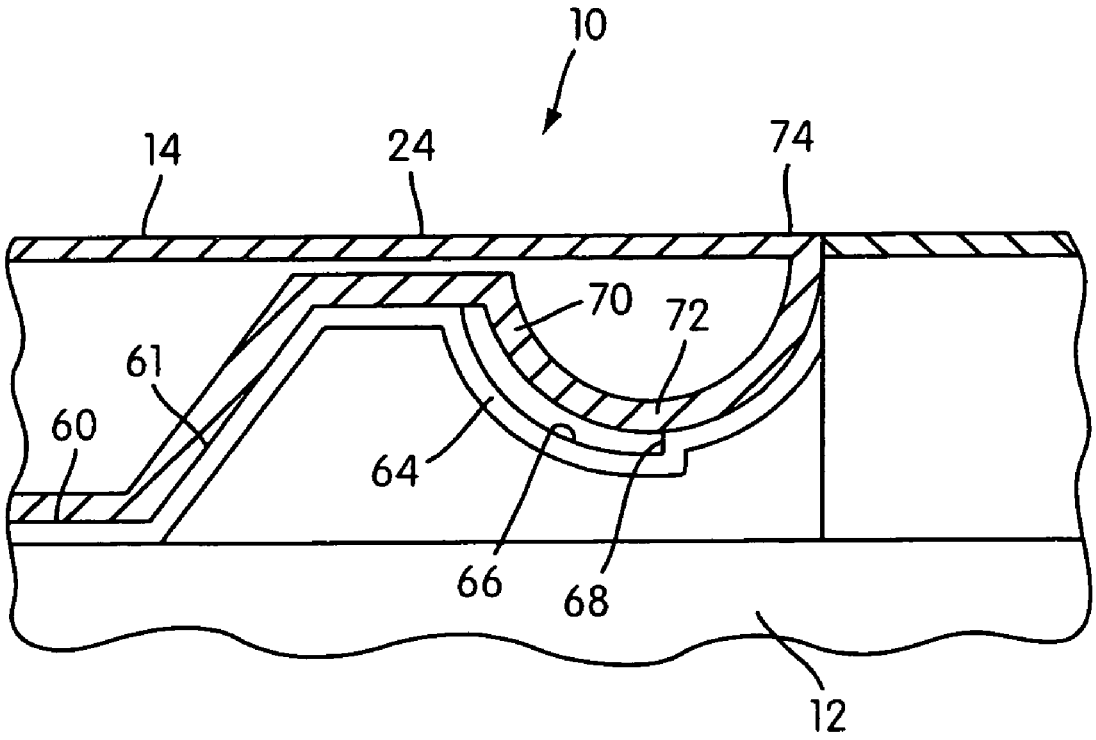
FIG. 6 is a cross-sectional view showing the pivot mount and the pivot guide of the shredder of FIG. 1 in its generally horizontal orientation.

4. Next, the user can lift the shredder 10 generally vertically off the upper peripheral edge 62 of the container 12, as shown in FIG. 5.

Figure 7:
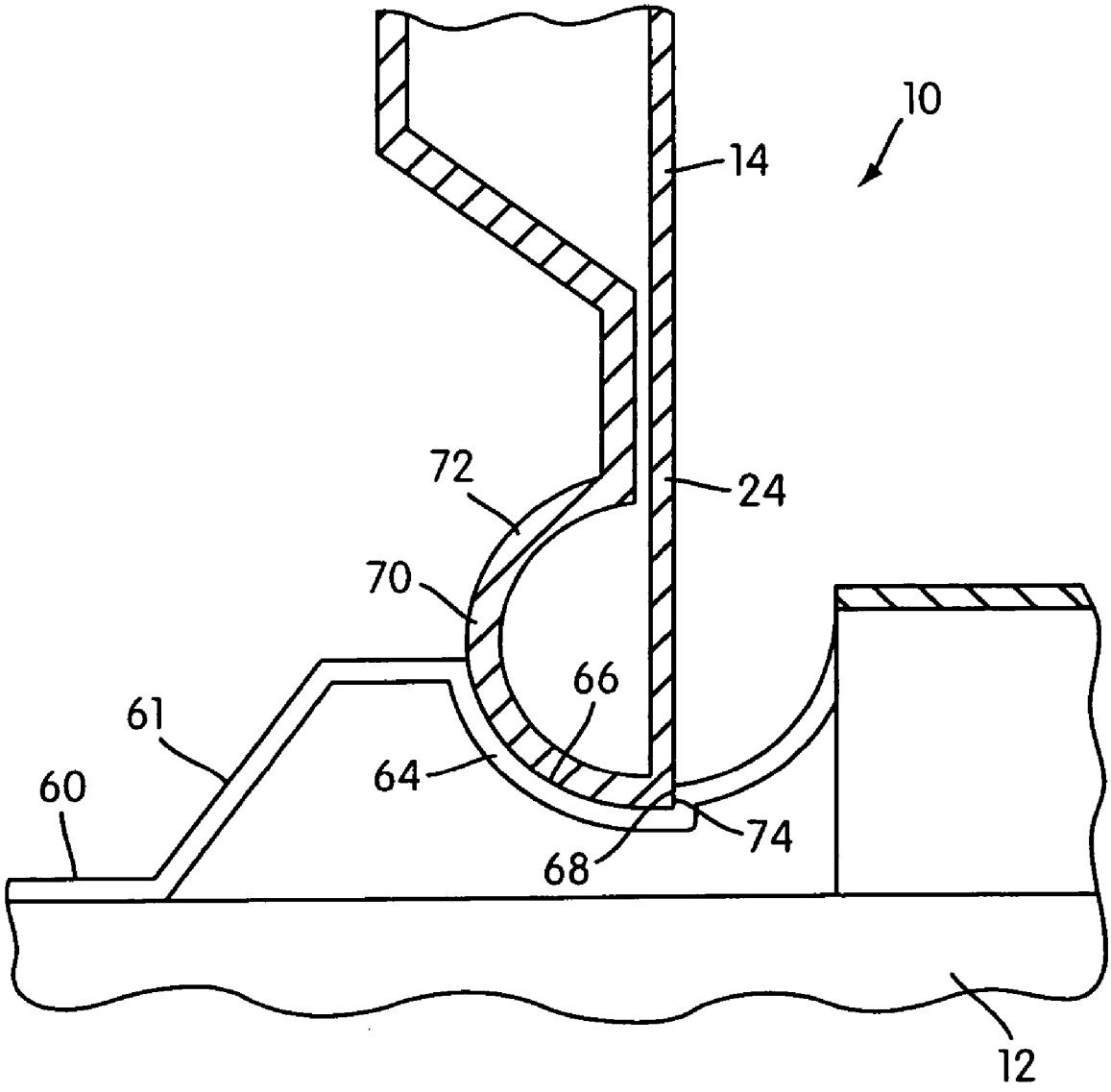
FIG. 7 is a cross-sectional view similar to FIG. 6 with the shredder in its generally vertical position.

As can be seen in FIG. 7, when the shredder 10 is in its generally vertical position, surfaces 74 at the upper edges of the walls 72 engage the engagement surfaces 68 on the recesses 66. This engagement provides support to the shredder 10 against movement thereof back towards the generally horizontal orientation. This is advantageous because it allows the user to easily lift the shredder 10 up off the seat 61. Also, when placing the shredder 10 back on the seat 61 (which is done by reversing the removal steps), the engagement between the surfaces 74 at the upper edges of the walls 72 and the engagement surfaces 68 help ensure proper location of the shredder 10.

It should be noted that the pivot guides 64 and the pivot mounts 70 may have any suitable construction or configuration and the example illustrated is in no way intended to be limiting.

In an alternative embodiment, the seat 61 could be a structure that is separate from the container 12 and could be designed for use with other types of containers. For example, the seat could be constructed so as to be adjustable for purposes of being removably mounted on a wide variety of containers. This would allow an end user to "retrofit" any type of container, such as a typical wastebasket, into a shredder container with the seat supporting the shredder 10. In this exemplary alternative, the shredder 10 and seat cold be sold together without the container, thus reducing packaging size and space. As such, the term seat is used herein to refer to any structure to which a shredder is mounted, and it is not limited to a seat that is integrally formed with a container as illustrated.

The foregoing illustrated embodiment has been provided to illustrate the structural and functional principles of the present invention and is not intended to be limiting. To the contrary, the present invention is intended to encompass all modifications, alterations and substitutions within the spirit and scope of the appended claims.

What is claimed is:

1. A shredder comprising:

a seat having a pivot guide comprising an upwardly facing recess;

a shredder housing including a pivot mount pivotally receivable in the upwardly facing recess of the pivot guide;

a shredder mechanism including a motor and cutter elements, the shredder mechanism enabling articles to be shredded to be fed into the cutter elements and the motor being operable to drive the cutter elements so that the cutter elements shred the articles fed therein, the shredder mechanism being mounted in the shredder housing;

the shredder housing being constructed to be removably mounted to the seat in a generally horizontal orientation with the pivot mount removably and pivotally received in the upwardly facing recess of the pivot guide;

the pivot mount and the pivot guide being constructed to pivotally mount the shredder housing for pivotal movement between the generally horizontal orientation and a generally vertical orientation.

2. A shredder according to claim 1, wherein the pivot mount and the pivot guide are constructed to provide support to the shredder housing in the generally vertical orientation against movement thereof towards the generally horizontal orientation, thereby facilitating a user (a) lifting the shredder housing in the generally vertical orientation off the seat with the pivot mount disengaging from the pivot guide and (b) lowering the shredder housing in the generally vertical orientation onto the seat with the pivot mount engaging the pivot guide and the pivotally moving the shredder housing downwardly to the generally horizontal orientation.

3. A shredder according to claim 2, wherein the seat is constructed to be removably mounted on an upper portion of a container having an upwardly facing opening so that the articles being shredded and discharged from the cutter elements are discharged into the container.

4. A shredder according to claim 3, wherein the shredder housing includes a waste opening spaced apart from the shredder mechanism that faces into the container when the seat is removably mounted thereon and the shredder housing is in the generally horizontal orientation for enabling articles to be discarded into the container without passing through the shredder mechanism.

5. A shredder according to claim 4, wherein the waste opening in the shredder housing is defined at least in part by a handle provided on the shredder housing, the handle being constructed to be manually grasped for moving the shredder housing between the generally horizontal and generally vertical orientations on the seat and lifting and lowering the shredder housing off of and onto the seat.

6. A shredder according to claim 5, wherein the handle and the waste opening are provided on a front portion of the shredder housing.

7. A shredder according to claim 6, wherein the handle has a pair of spaced apart connector portions extending form the shredder housing and a hand grip portion extending between the connector portions in spaced apart relation from the shredder housing, the hand grip portion and the connector portions defining part of the waste opening.

8. A shredder according to claim 2, further comprising a container, wherein the seat is provided by an upper peripheral edge of the container so that the articles being shredded and discharged from the cutter elements are discharged into the container.

9. A shredder according to claim 8, wherein the shredder housing includes a waste opening spaced apart from the shredder mechanism that faces into the container when the shredder mechanism is in the generally horizontal orientation for enabling articles to be discarded into the container without passing through the shredder mechanism.

10. A shredder according to claim 9, wherein the waste opening in the shredder housing is defined at least in part by a handle provided on the shredder housing, the handle being constructed to be manually grasped for moving the shredder housing between the generally horizontal and generally vertical orientations on the seat and lifting and lowering the shredder housing off of and onto the seat.

11. A shredder according to claim 10, wherein the handle and the waste opening are provided on a front portion of the shredder housing.

12. A shredder according to claim 11, wherein the handle has a pair of spaced apart connector portions extending from the shredder housing and a hand grip portion extending between the connector portions in spaced apart relation from the shredder housing, the hand grip portion and the connector portions defining part of the waste opening.

13. A shredder according to claim 2, further comprising a handle provided on the shredder housing, the handle being constructed to be manually grasped for moving the shredder housing between the generally horizontal and generally vertical orientations on the seat and lifting and lowering the shredder housing off of and onto the seat.

14. A shredder according to claim 13, wherein the pivot guide includes a pair of pivot guides provided on opposing lateral sides of the seat, each of said pivot guides comprising an upwardly facing recess, and wherein the pivot mount includes a pair of pivot mounts provided on opposing lateral sides of the shredder housing, each of the pivot mounts being pivotally receivable in a respective upwardly facing recess.

15. A shredder according to claim 14, wherein the handle is provided on a front portion of the shredder housing.

16. A shredder according to claim 15, wherein the handle has a pair of spaced apart connector portions extending from the shredder housing and a hand grip portion extending between the connector portions in spaced apart relation from the shredder housing.

17. A shredder according to claim 14 wherein each of the upwardly facing recesses has a generally vertical engagement surface provided in a bottom thereof, the pivot guides and the pivot mounts being constructed such that when the shredder mechanism housing is in the generally vertical orientation thereof the surfaces on the pivot mounts are engaged with the generally vertical engagement surfaces to provide support to the shredder mechanism housing in the generally vertical orientation against movement thereof towards the generally horizontal orientation as aforesaid, the pivot guides and the pivot mounts being constructed such that the pivot mounts disengage from the generally vertical engagement surfaces as the shredder mechanism housing is moved from the generally vertical orientation to the generally horizontal orientation.

18. A shredder according to claim 17, wherein the handle is provided on a front portion of the shredder housing.

19. A shredder according to claim 18, wherein the handle has a pair of spaced apart connector portions extending from the shredder housing and a hand grip portion extending between the connector portions in spaced apart relation from the shredder housing.

20. A shredder according to claim 13, wherein the handle is provided on a front portion of the shredder housing.

21. A shredder according to claim 20, wherein the handle has a pair of spaced apart connector portions extending from the shredder housing and a hand grip portion extending between the connector portions in spaced apart relation from the shredder housing.

22. A shredder according to claim 1, further comprising a handle provided on the shredder housing, the handle being constructed to be manually grasped for moving the shredder housing between the generally horizontal and generally vertical orientations on the seat and lifting and lowering the shredder housing off of and onto the seat.

23. A shredder according to claim 22, wherein the handle is provided on a front portion of the shredder housing.

24. A shredder according to claim 23, wherein the handle has a pair of spaced apart connector portions extending from the shredder housing and a hand grip portion extending between the connector portions in spaced apart relation from the shredder housing.

25. A shredder comprising:

a seat having a pivot guide;

a shredder housing including a pivot mount;

a shredder mechanism including a motor and cutter elements, the shredder mechanism enabling articles to be shredded to be fed into the cutter elements and the motor being operable to drive the cutter elements so that the cutter elements shred the articles fed therein, the shredder mechanism being mounted in the shredder housing;

the shredder housing being constructed to be removably mounted to the seat in a generally horizontal orientation with the pivot mount removably engaged with the pivot guide;

the pivot mount and the pivot guide being constructed to pivotally mount the shredder housing for pivotal movement between the generally horizontal orientation and a generally vertical orientation; and a handle provided on the shredder housing, the handle being constructed to be manually grasped for moving the shredder housing between the generally horizontal and generally vertical orientations on the seat and lifting and lowering the shredder housing off of and onto the seat;

wherein the pivot guide includes a pair of said pivot guides provided on opposing lateral sides of the seat and wherein the pivot mount includes a pair of said pivot mounts provided on opposing lateral sides of the shredder housing.

26. A shredder according to claim 25, wherein the pivot mounts and the pivot guides each have support surfaces positioned to engage one another to support the shredder housing in the generally vertical orientation against pivotal movement.

27. A shredder according to claim 26, wherein the pivot guides include upwardly facing recesses.

28. A shredder according to claim 27, wherein the handle is provided on a front portion of the shredder housing.

29. A shredder according to claim 27, wherein the support surfaces of the pivot guides are generally vertical and are provided in the bottoms of the upwardly facing recesses, the pivot guides and the pivot mounts being constructed such that when the shredder mechanism housing is in the generally vertical orientation thereof the support surfaces on the pivot mounts are engaged with the generally vertical support surfaces to provide support to the shredder mechanism housing in the generally vertical orientation against pivotal movement thereof back towards the generally horizontal orientation, the pivot guides and the pivot mounts being constructed such that support surfaces on the pivot mounts disengage from the support surfaces of the pivot guides as the shredder mechanism housing is moved from the generally vertical orientation to the generally horizontal orientation.

30. A shredder according to claim 26, wherein the handle is provided on a front portion of the shredder housing.

31. A shredder according to claim 26, wherein the support surfaces of the pivot mounts and the pivot guides are constructed to provide support to the shredder housing in the generally vertical orientation against pivotal movement thereof back towards the generally horizontal orientation, thereby facilitating a user (a) lifting the shredder housing in the generally vertical orientation off the seat with the pivot mounts disengaging from the pivot guides and (b) lowering the shredder housing in the generally vertical orientation onto the seat with the pivot mounts engaging the pivot guides and the pivotally moving the shredder housing downwardly to the generally horizontal orientation.

32. A shredder according to claim 31, wherein the pivot guides include upwardly facing recesses.

33. A shredder according to claim 32, wherein the support surfaces of the pivot guides are generally vertical and are provided in the bottoms of the upwardly facing recesses, the pivot guides and the pivot mounts being constructed such that when the shredder mechanism housing is in the generally vertical orientation thereof the support surfaces on the pivot mounts are engaged with the generally vertical support surfaces to provide support to the shredder mechanism housing in the generally vertical orientation against pivotal movement thereof back towards the generally horizontal orientation, the pivot guides and the pivot mounts being constructed such that support surfaces on the pivot mounts disengage from the support surfaces of the pivot guides as the shredder mechanism housing is moved from the generally vertical orientation to the generally horizontal orientation.

34. A shredder according to claim 25, wherein the pivot guides include upwardly facing recesses.

35. A shredder according to claim 34, wherein the handle is provided on a front portion of the shredder housing.

36. A shredder according to claim 25, wherein the handle is provided on a front portion of the shredder housing.

37. A shredder according to claim 36, wherein the handle has a pair of spaced apart connector portions extending from the shredder housing and a hand grip portion extending between the connector portions in spaced apart relation from the shredder housing.

38. A shredder according to claim 25, wherein the seat is constructed to be removably mounted on an upper portion of a container having an upwardly facing opening so that the articles being shredded and discharged from the cutter elements are discharged into the container.

39. A shredder according to claim 38, wherein the shredder housing includes a waste opening spaced apart from the shredder mechanism that faces into the container when the seat is removably mounted thereon and the shredder housing is in the generally horizontal orientation for enabling articles to be discarded into the container without passing through the shredder mechanism.

40. A shredder according to claim 39, wherein the waste opening in the shredder housing is defined at least in part by the handle provided on the shredder housing.

41. A shredder according to claim 40, wherein the handle and the waste opening are provided on a front portion of the shredder housing.

42. A shredder according to claim 41, wherein the handle has a pair of spaced apart connector portions extending from the shredder housing and a hand grip portion extending between the connector portions in spaced apart relation from the shredder housing, the hand grip portion and the connector portions defining part of the waste opening.

43. A shredder according to claim 25, further comprising a container, wherein the seat is provided by an upper peripheral edge of the container so that the articles being shredded and discharged from the cutter elements are discharged into the container.

44. A shredder according to claim 43, wherein the shredder housing includes a waste opening spaced apart from the shredder mechanism that faces into the container when the shredder mechanism is in the generally horizontal orientation for enabling articles to be discarded into the container without passing through the shredder mechanism.

45. A shredder according to claim 44, wherein the waste opening in the shredder housing is defined at least in part by the handle provided on the shredder housing.

46. A shredder according to claim 45, wherein the handle and the waste opening are provided on a front portion of the shredder housing.

47. A shredder according to claim 46, wherein the handle has a pair of spaced apart connector portions extending from the shredder housing and a hand grip portion extending between the connector portions in spaced apart relation from the shredder housing, the hand grip portion and the connector portions defining part of the waste opening.

48. A shredder comprising:

a seat having a pivot guide;

a shredder housing including a pivot mount;

a shredder mechanism including a motor and cutter elements, the shredder mechanism enabling articles to be shredded to be fed into the cutter elements and the motor being operable to drive the cutter elements so that the cutter elements shred the articles fed therein, the shredder mechanism being mounted in the shredder housing;

the pivot guide and the pivot mount including (a) an open recess with a receiving opening and (b) a pivot member configured to be removably received in said recess through said receiving opening;

the shredder housing being constructed to be removably mounted to the seat in a generally horizontal orientation with the pivot mount and the pivot guide removably and pivotally coupled together by the pivot member being removably received in the open recess through the receiving opening;

the pivot mount and the pivot guide being constructed to pivotally guide the shredder housing for pivotal movement between the generally horizontal orientation and a generally vertical orientation, and enable the shredder housing to be removed from the seat by disengaging the pivot mount from the pivot guide with the pivot member being withdrawn from the open recess through the opening thereof.

49. A shredder according to claim 48, wherein the pivot guide includes the open recess, and wherein the pivot mount includes the pivot member, the receiving opening of the open recess being an upwardly facing opening.

50. A shredder according to claim 49, wherein the pivot guide includes a pair of said pivot guides provided on opposing lateral sides of the seat and wherein the pivot mount includes a pair of said pivot mounts provided on opposing lateral sides of the shredder housing.

51. A shredder according to claim 49, wherein each pivot mount and each pivot guide has a support surface, the support surfaces being positioned to engage one another to support the shredder housing in the generally vertical orientation against pivotal movement.

52. A shredder according to claim 51, wherein the support surface of each pivot guide is generally vertical and is provided in the bottom of its upwardly facing recess, each pivot guide and each pivot mount being constructed such that when the shredder mechanism housing is in the generally vertical orientation thereof the support surfaces on each pivot mounts is engaged with the generally vertical support surface on each pivot guide to provide support to the shredder mechanism housing in the generally vertical orientation against pivotal movement thereof back towards the generally horizontal orientation, each pivot guide and each pivot mount being constructed such that the support surface of each pivot mount disengages from the generally vertical support surface as the shredder mechanism housing is moved from the generally vertical orientation to the generally horizontal orientation.

53. A shredder according to claim 49, further comprising a handle provided on the shredder housing, the handle being constructed to be manually grasped for moving the shredder housing between the generally horizontal and generally vertical orientations on the seat and lifting and lowering the shredder housing off of and onto the seat.

54. A shredder according to claim 53, wherein the pivot guide includes a pair of said pivot guides provided on opposing lateral sides of the seat and wherein the pivot mount includes a pair of said pivot mounts provided on opposing lateral sides of the shredder housing.

55. A shredder according to claim 54, wherein each pivot mount and each pivot guide has a support surface, the support surfaces being positioned to engage one another to support the shredder housing in the generally vertical orientation against pivotal movement.

56. A shredder according to claim 53, wherein each pivot mount and each pivot guide has a support surface, the support surfaces being positioned to engage one another to support the shredder housing in the generally vertical orientation against pivotal movement.

57. A shredder according to claim 53, wherein the handle is provided on a front portion of the shredder housing.

58. A shredder according to claim 57, wherein the handle has a pair of spaced apart connector portions extending from the shredder housing and a hand grip portion extending between the connector portions in spaced apart relation from the shredder housing.

59. A shredder according to claim 53, wherein the seat is constructed to be removably mounted on an upper portion of a container having an upwardly facing opening so that the articles being shredded and discharged from the cutter elements are discharged into the container.

60. A shredder according to claim 59, wherein the shredder housing includes a waste opening spaced apart from the shredder mechanism that faces into the container when the seat is removably mounted thereon and the shredder housing is in the generally horizontal orientation for enabling articles to be discarded into the container without passing through the shredder mechanism.

61. A shredder according to claim 60, wherein the waste opening in the shredder housing is defined at least in part by the handle provided on the shredder housing.

62. A shredder according to claim 61, wherein the handle and the waste opening are provided on a front portion of the shredder housing.

63. A shredder according to claim 61, wherein the handle has a pair of spaced apart connector portions extending from the shredder housing and a hand grip portion extending between the connector portions in spaced apart relation from the shredder housing, the hand grip portion and the connector portions defining part of the waste opening.

64. A shredder according to claim 53, further comprising a container, wherein the seat is provided by an upper peripheral edge of the container so that the articles being shredded and discharged from the cutter elements are discharged into the container.

65. A shredder according to claim 64, wherein the shredder housing includes a waste opening spaced apart from the shredder mechanism that faces into the container when the shredder mechanism is in the generally horizontal orientation for enabling articles to be discarded into the container without passing through the shredder mechanism.

66. A shredder according to claim 65, wherein the waste opening in the shredder housing is defined at least in part by the handle provided on the shredder housing, wherein the waste opening in the shredder housing is defined at least in part by the handle provided on the shredder housing.

67. A shredder according to claim 66, wherein the handle and the waste opening are provided on a front portion of the shredder housing.

68. A shredder according to claim 67, wherein the handle has a pair of spaced apart connector portions extending from the shredder housing and a hand grip portion extending between the connector portions in spaced apart relation from the shredder housing, the hand grip portion and the connector portions defining part of the waste opening.

69. A shredder according to claim 48, further comprising a handle provided on the shredder housing, the handle being constructed to be manually grasped for moving the shredder housing between the generally horizontal and generally vertical orientations on the seat and lifting and lowering the shredder housing off of and onto the seat.

70. A shredder according to claim 69, wherein the pivot guide includes a pair of said pivot guides provided on opposing lateral sides of the seat and wherein the pivot mount includes a pair of said pivot mounts provided on opposing lateral sides of the shredder housing.

71. A shredder according to claim 69, wherein the handle is provided on a front portion of the shredder housing.

72. A shredder according to claim 48, wherein the pivot guide includes a pair of said pivot guides provided on opposing lateral sides of the seat and wherein the pivot mount includes a pair of said pivot mounts provided on opposing lateral sides of the shredder housing.

73. A shredder according to claim 48, wherein each pivot mount and each pivot guide has a support surface, the support surfaces being positioned to engage one another to support the shredder housing in the generally vertical orientation against pivotal movement.

74. A shredder according to claim 73, wherein the support surfaces are constructed to provide support to the shredder housing in the generally vertical orientation against pivotal movement thereof back towards the generally horizontal orientation, thereby facilitating a user (a) lifting the shredder housing in the generally vertical orientation off the seat with the pivot mount disengaging from the pivot guide and (b) lowering the shredder housing in the generally vertical orientation onto the seat with the pivot mount engaging the pivot guide and the pivotally moving the shredder housing downwardly to the generally horizontal orientation.

* * * * *

UNITED STATES PATENT AND TRADEMARK OFFICE

CERTIFICATE OF CORRECTION

PATENT NO. : 7,025,293 B2
APPLICATION NO. : 10/828254
DATED : April 11, 2006
INVENTOR(S) : Taihoon K. Matlin et al.

It is certified that error appears in the above-identified patent and that said Letters Patent is hereby corrected as shown below:

On cover page, item (73) Assignee
replace "Fellows Inc."
with -- Fellowes Inc.--

Signed and Sealed this

First Day of August, 2006

JON W. DUDAS
*Director of the United States Patent and Trademark Office*